United States Patent [19]

Staton

[11] 4,051,773

[45] Oct. 4, 1977

[54] MILLING ROLL

[76] Inventor: Lynn D. Staton, Rte. 1, Box 22 D, Stuttgart, Ark. 72160

[21] Appl. No.: 692,234

[22] Filed: June 2, 1976

[51] Int. Cl.[2] ..... B02B 3/02

[52] U.S. Cl. ..... 99/622; 99/609; 426/482; 426/483; 366/228; 366/234

[58] Field of Search ..... 426/482, 483; 99/522, 99/609, 611, 629, 630, 622; 51/164, 313; 259/81 R, 89, 90

[56] References Cited

U.S. PATENT DOCUMENTS

| | | | |
|---|---|---|---|
| 483,868 | 10/1892 | Prochaska | 426/483 |
| 3,379,632 | 4/1968 | Henig | 259/89 |

FOREIGN PATENT DOCUMENTS

| | | | |
|---|---|---|---|
| 1,657,110 | 4/1970 | Germany | 99/630 |

*Primary Examiner*—S. Leon Bashore

*Assistant Examiner*—Peter Chin

*Attorney, Agent, or Firm*—Clarence A. O'Brien; Harvey B. Jacobson

[57] ABSTRACT

A milling roll for use in a rice milling machine for removing the bran coating from the exterior surface of the rice kernels, in which the rice kernels are caused to rub or roll against each other rather than between relatively moving surfaces. The milling roll is generally cylindrical in construction with spaced baffles oriented at particular angular positions so that rice kernels will enter the milling roll between certain of the adjacent baffles from the periphery of the rotating roll toward the center thereof where the rice kernels will be caused to rub against each other as they work in and out and are ultimately discharged between adjacent baffles peripherally of the milling roll for discharge from the rice milling machine through the usual rice outlet or discharge spout past the usual pressure plate control mechanism.

5 Claims, 4 Drawing Figures

MILLING ROLL

BACKGROUND OF THE INVENTION

1. Field of the Invention

The present invention generally relates to an improved and unique milling roll for use in a rice milling machine or rice whitening machine as a replacement for the existing milling roller in which the rice kernels are moved inwardly into the interior of the milling roll and the kernels of rice are rubbed against each other for removing the bran coatings rather than being rubbed against a screen surface.

2. Description of the Prior Art

Rice is one of the world's principal food crops and is grown in many areas having suitable soil and climate conditions. Rice kernels, when harvested, have an outside hull, underlying bran coatings and a hard, starchy kernel. While various harvesting and thrashing methods have been used, in order to increase production while maintaining labor costs at a minimum, mechanical harvesters and thrashers have been developed for harvesting rice. Various commercially available combines are employed for harvesting and thrashing rice thus producing rough rice or paddy which still has the hull in place and this rough rice is then milled by first removing the hulls and then polishing or whitening the rice kernels by removing the bran coatings. The technique of whitening or polishing rice kernels has involved the rubbing of the rice kernels between relatively moving surfaces. Rice millers initially utilized revolving bands or felt or soft leather to polish and smooth the kernels with this process effectively rubbing off bran coatings and some of the kernel starch. Subsequent rice milling machines have utilized a rotating milling roller disposed internally of a stationary screen so that the rice kernels are rubbed against the screen which abraded the bran coatings and permitted discharge of the bran coatings from the screen with the polished rice being discharged from a discharge spout. Various commercially available rice milling machines are available with one type of rice whitening machine being manufactured by Satake which is sometimes referred to as rice pearler. This type of device is disclosed in prior U.S. Pat. No. 3,179,140, issued Apr. 20, 1965. One of the problems resulting from the polishing or whitening of rice by the use of existing rice milling machines is the breakage of kernels. After the rice has been polished or whitened, sorting machines are used to separate the broken and unbroken kernels since rice is sold in accordance with grades with "head" rice consisting chiefly of perfect kernels while "second head" rice has substantial quantities of larger broken pieces with both of these grades being used as food and sold as fancy or choice rice depending on the color and the presence of weed seeds. The "screenings" or finely broken pieces of rice kernels are ground and used in flour mixes or sold as brewer's rice for use in distilling and brewing industries.

SUMMARY OF THE INVENTION

An object of the present invention is to provide a milling roll for use in rice milling machines which includes structural features that pulls the rice kernels away from the screen in the existing rice milling machine and causes the rice kernels to rub against each other rather than being rubbed against the screen by the external surface of the rice milling roller thereby removing the bran coating in a much more gentle manner thereby resulting in less broken rice kernels.

Another object of the invention is to provide a rice milling roll constructed with angulated and curved baffles which extend radially and peripherally in a specific manner to effectively move the rice inwardly in relation to the periphery of the milling roll, cause the rice to tumble and roll against itself and then be discarded peripherally of the milling roll.

Still another object of the invention is to provide a rice milling roll which will replace the conventional milling roller in commercially available rice milling machines without any modification whatsoever to the existing rice milling machine structure thereby eliminating the necessity to redesign or change the basic rice milling operation while obtaining a better quality rice of a higher grade while maintaining substantially the same production rate.

Still a further object of the present invention is to provide a rice milling roll which is quite simple in construction, long lasting, easily assembled onto the main shaft of a conventional rice milling machine and relatively inexpensive to manufacture and maintain.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
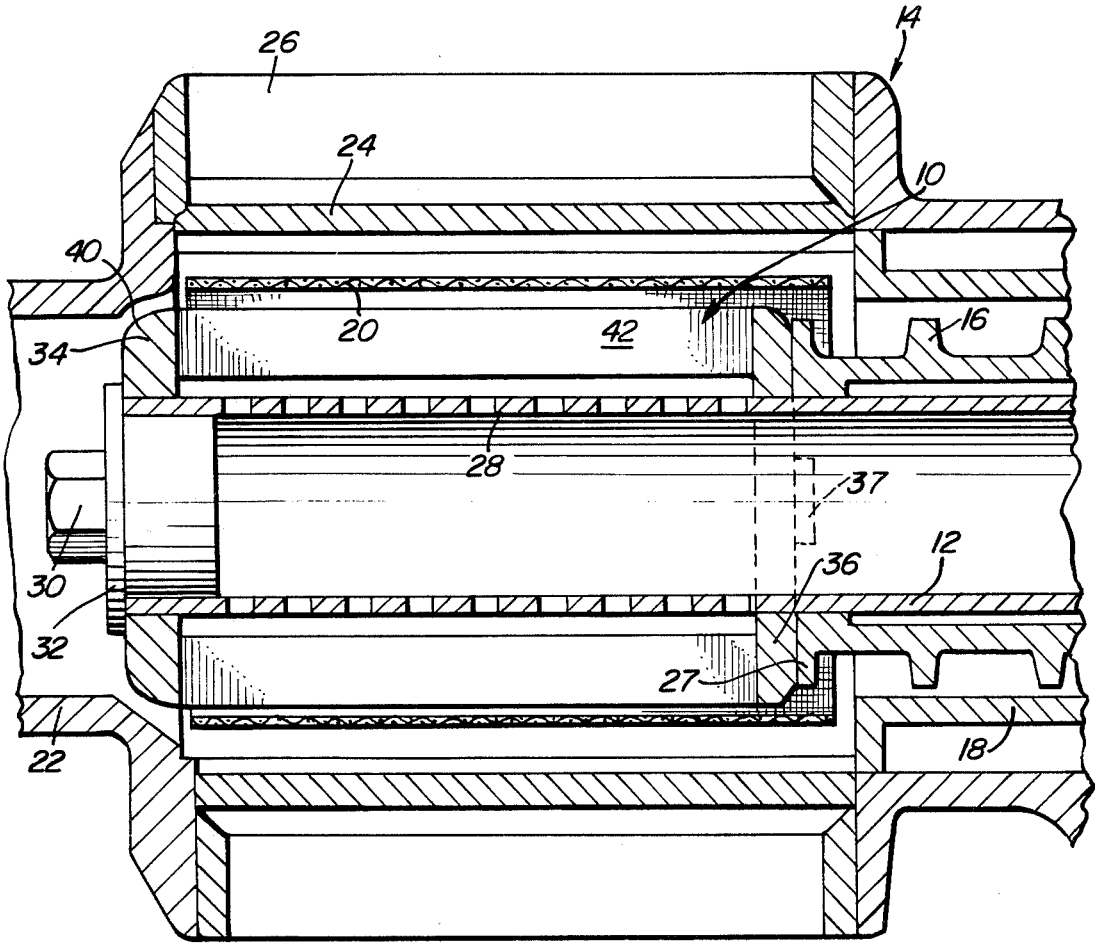
FIG. 1 is a longitudinal, sectional view of a portion of a rice milling machine with the rice milling roll of the present invention incorporated therein as a substitute for the conventional rice milling roller.
Figure 4:
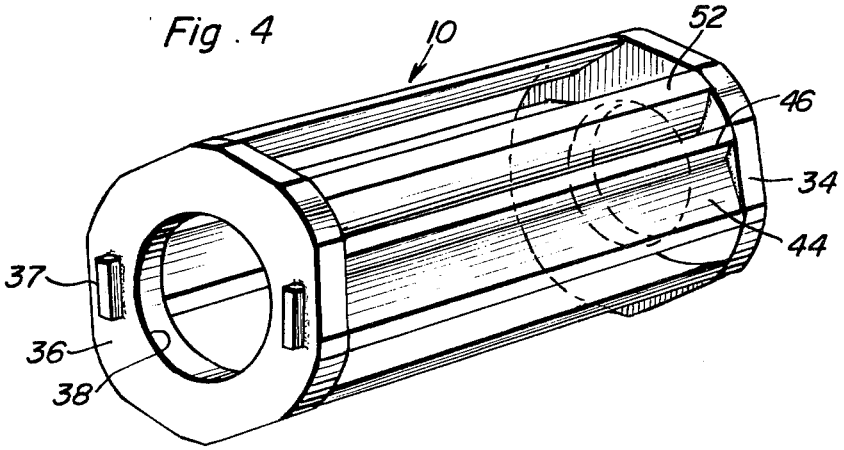
FIG. 4 is a perspective view of the milling roll.
Figure 2:
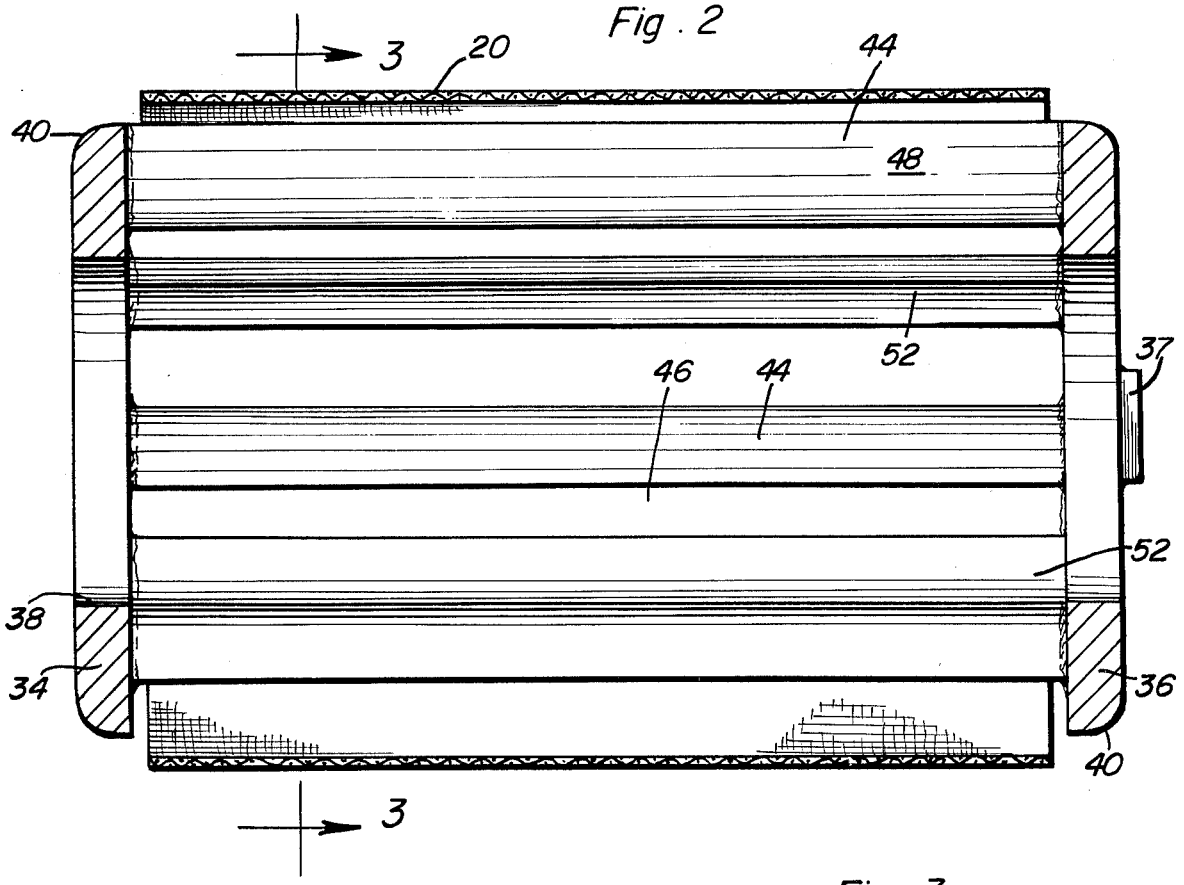
FIG. 2 is a longitudinal, sectional view of the rice milling roll and the screen of a conventional rice milling machine on an enlarged scale as compared with FIG. 1.

The milling roll of the present invention is generally designated by reference numeral 10 and, in FIG. 1, it is illustrated on the main shaft 12 of a rice milling machine generally designated by numeral 14 which may be type BA-3, BA-4, BA-7 or BA-15 "Pearlmaster" manufactured by Satake. In the Satake "Pearlmaster", a screwed iron roller 16 conveys the rice through an inner cylinder 18 from a supply hopper to the milling roll 10 internally of a stationary screen 20. After the rice has been polished or whitened, it is discharged through an outlet 22 through a pressure plate assembly (not shown). The screen 20 is supported by an inner frame 24 and an outer frame 26 and the main shaft 12 is provided with perforations 28 interiorly of the milling roll 10 for discharge of air which is circulated through the hollow main shaft 12 from a fan located remotely from the milling roll so that the bran coating removed from the rice kernels is entrained in the circulating air and discharged peripherally of the screen. Except for the specific structural details of the milling roll 10, the structure of the rice milling machine is conventional and the milling roll 10 constituted the present invention is installed directly on the hollow main shaft 12 between a flange 27 on the screwed iron roller 16 and a retaining bolt 30 and washer 32 attached to the end of the main shaft 12 to enable the milling roll to be removed. Thus, in order to install the milling roll of the present invention on a conventional rice milling machine, it is only necessary to remove the bolt 30 and washer 32, remove the conventional milling roller and insert the milling roll 10 of the present invention on the main shaft 12 and replace the washer 32 and bolt 30.

The milling roll 10 includes a pair of parallel annular end plates 34 and 36 each of which is provided with an internal hole 38 of a diameter to be closely received on the main shaft 12 with the outer corners of the end plates 34 and 36 being rounded or bevelled as at 40 to facilitate passage of rice kernels longitudinally of the milling roll 10. The end plates 34 and 36 are identical except that end plate 36 has two diametrically opposed, axially projecting lugs 37 welded or otherwise rigid therewith for reception in corresponding slots in the flange 27 on iron screwed roller 16 thus drivingly locking the milling roll 10 and the iron screwed roller 16 together. Extending between and rigidly secured to the end plates 34 and 36, such as by welding or the like, are four angled baffle plates 42 which are equally spaced circumferentially of the end plates 34 and 36 and which are parallel to each other and of identical construction.

Figure 3:
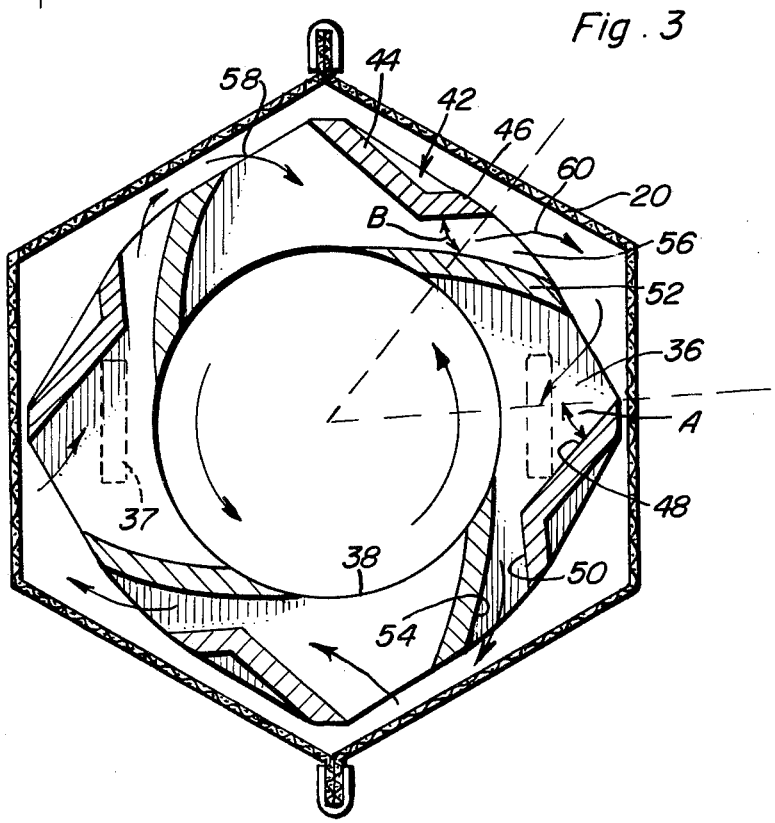
FIG. 3 is a transverse, sectional view taken substantially upon a plane passing along sectional line 3—3 of FIG. 2 illustrating the specific structural details of the milling roll and its relationship to the stationary screen.

Each angled baffle plate 42 includes a relatively elongated angulated portion 44 and a relatively short angulated portion 46 with the two portions of the plate 42 being of unitary construction. The terminal ends of both portions 44 and 46 terminate flush with the periphery of the end plates 34 and 36 and are configured to conform with the peripheral edge surface of the end plate so that, in effect, the outer edge surfaces of the baffle plates 42 are co-planar with the edge surfaces of the end plates 34 and 36 where they intersect. The inner surface of the long portion 44 of the baffle plate 42 is angularly inclined with respect to a radial plane intersecting the outer end of this surface. This inclined surface, designated by numeral 48, and a radius from the center of the roll to the outer end of the surface defines an included angle A of approximately 45° so that when rice engages the surface 48 and the roll is rotating in a counterclockwise direction as observed in FIG. 3, the surface 48 will deflect or pull rice kernels inwardly from the periphery of the milling roll. The shorter portion 46 of the baffle plate 42 has an inclined surface 50 which defines an included angle B of approximately 60° with a radius extending from the outer end of the surface 50 to the center of the milling roll. The juncture between the surfaces 48 and 50 is located approximately midway between the outer perimeter of the end plates and the periphery of the central opening 38 as illustrated in FIG. 3.

Also, the milling roll includes four circumferentially spaced curved baffle plates 52 which are equally spaced circumferentially of the milling roll and are located between the angled baffle plates 42. Each of the curved baffle plates includes an inner end terminating flush with the periphery of the opening 38 and an outer end terminating flush with the periphery of the end plates 34 and 36 with the outwardly disposed surface of the curved baffle plate 52 being designated by numeral 54 which is spaced from the surface 50 of the short portion 46 of the angled baffle plate 42 with the surface 54 diverging slightly outwardly in relation to the surface 50 thus providing a discharge throat 56 for rice kernels which have been pulled inwardly by the surface 48 as indicated by the arrows 58 and 60 in FIG. 3.

Thus, the counterclockwise rotation of the milling roll 10 provides four entrance areas for the rice kernels and four exit areas in which the entrance areas are somewhat larger than the exit areas thereby assuring that the rice kernels will be rubbed against each other as they work themselves inwardly and outwardly in relation to the baffle plates 42 and 52. The central main shaft 12 provides a closure for the interior of the roll with the perforations 28 therein being of a size which will not permit entry of rice kernels and air pressure interiorly of the main shaft 12 provides for air flow through the main shaft and outwardly of the milling roll through the screen 20 to entrain the removed bran coating therein in the same manner as the conventional operation in a rice milling machine. The gentle tumbling and rubbing action of the milling roll results in substantially less breakage to the rice kernels as compared with the conventional rice milling roller in which the rice kernels are rubbed against a relatively rough, rigid screen 20. In actual practice, a milling roll having an overall length of 9¼ inches, a hole diameter of 2 13/16 inches and an outside diameter at its widest four point of 5⅜ inches has been substituted for the milling roller on a type BA-15 "Pearlmaster" with all operating conditions remaining the same. Under such operating conditions, the resultant rice kernel product has contained substantially less broken kernels. By using end plates of one half inch thickness and baffles of one quarter inch thickness, capacity of the existing rice milling machine has been maintained substantially constant but with a reduction in broken kernels of rice of approximately 15% to 18%. This enables a higher price to be obtained for a given quantity of rough rice or paddy by virtue of a larger quantity of "head" rice being obtained as a result of the rice milling operation.

The rice milling roll of the present invention may be substituted for the existing rice milling roller on various types of commercial rice milling machines with the dimensional characteristics of the rice milling roll being altered as necessary to fit into the screen of existing rice milling machines with the interior dimensions and length dimensions being correspondingly altered to conform with the particular machine in which the conventional milling roller is removed and the present milling roll substituted therefor.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a rice rolling machine having a frame supporting a stationary screen provided with a peripheral screen wall, a rotatable main shaft disposed centrally of said screen, an inlet at one end of the screen and an outlet at the other end thereof, a milling roll comprising a pair of longitudinally spaced end plates, a plurality of longitudinally elongated, spaced baffle plates rigidly interconnecting said end plates with the space between the baffle plates being open, each of said end plates being annular and including a large central opening receiving the main shaft of the rice milling machine, said baffle plates including a plurality of equally and circumferentially spaced first angled baffles having a radially inwardly inclined surface and an equal number of circumferentially spaced second arcuately curved baffles having a radially outwardly inclined surface, said first angled baffles serving to move rice kernels radially inwardly from the periphery of the milling roll and screen toward the main shaft during rotation of the milling roll and the second arcuately curved baffles serving to move rice kernels radially outwardly of the milling roll during rotation thereby rubbing the rice kernels together for removing the bran coating.

2. The structure as defined in claim 1, wherein each of said first baffles is angular in cross section and includes an elongated portion having one edge terminating flush with the external periphery of the end plates and an inner edge terminating generally centrally of the radial dimension of the end plates and a short portion having an outer edge terminating flush with the periphery of the end plate and an inner edge unitary with the inner edge of the elongated portion with the short portion in trailing relation thereto during rotation of the roll, the inner surface of the elongated portion of the first baffle defining an included angle with a radius of the roll passing through the outer edge thereof less than the included angle between a radius of the roll and the outer edge of the inner surface of the short portion of the first baffle.

3. The structure as defined in claim 2, wherein each second baffle is an arcuately curved baffle which curves from an inner edge terminating flush with the inner edge of the annular end plate and an outer edge flush with the outer edge of the end plate with the outer edge of the arcuate baffle being disposed in trailing relation to the inner edge thereof when the milling rod is rotating.

4. The structure as defined in claim 3, wherein the convex surface of the arcuate baffle is spaced from the short portion of the angular baffle with the outer end portion of the arcuate baffle diverging from the outer end portion of the short portion of the angled baffle whereby rice kernels are directed inwardly between the end plates by the inner surface of the elongated portion of the angled baffle and exit between the arcuate baffle and the short portion of the angled baffle with the rice kernels rubbing against each other in a gentle manner when they are worked inwardly and outwardly between the end plates thereby removing the bran coating with less breakage of the rice kernels.

5. The structure as defined in claim 4, wherein said end plates have circumferentially spaced high points on the periphery thereof corresponding to the points of connection of the outer edge of the elongated portion of the angled baffles to facilitate movement of the rice kernels away from the screen in the rice milling machine thereby reducing rubbing action of the rice kernels against the stationary screen.

* * * * *